US010953419B2

(12) United States Patent
Hanada et al.

(10) Patent No.: US 10,953,419 B2
(45) Date of Patent: Mar. 23, 2021

(54) GAS ATOMIZATION NOZZLE AND GAS ATOMIZATION DEVICE

(71) Applicant: MITSUBISHI HEAVY INDUSTRIES AERO ENGINES, LTD., Aichi (JP)

(72) Inventors: Tadayuki Hanada, Aichi (JP); Kenji Suzuki, Tokyo (JP); Satoru Yamazaki, Aichi (JP); Kenji Doi, Osaka (JP); Shuntaro Terauchi, Osaka (JP); Hisashi Kitagaki, Osaka (JP)

(73) Assignee: MITSUBISHI HEAVY INDUSTRIES AERO ENGINES, LTD., Aichi (JP)

( * ) Notice: Subject to any disclaimer, the term of this patent is extended or adjusted under 35 U.S.C. 154(b) by 29 days.

(21) Appl. No.: 16/320,547

(22) PCT Filed: Jan. 25, 2018

(86) PCT No.: PCT/JP2018/002303
§ 371 (c)(1),
(2) Date: Jan. 25, 2019

(87) PCT Pub. No.: WO2018/139544
PCT Pub. Date: Aug. 2, 2018

(65) Prior Publication Data

US 2019/0270103 A1 Sep. 5, 2019

(30) Foreign Application Priority Data

Jan. 27, 2017 (JP) ..... JP2017-013238

(51) Int. Cl.
*B05B 7/10* (2006.01)
*B05B 7/16* (2006.01)
(Continued)

(52) U.S. Cl.
CPC ..... *B05B 7/10* (2013.01); *B05B 7/16* (2013.01); *B22F 9/08* (2013.01); *B22F 9/10* (2013.01)

(58) Field of Classification Search
CPC ..... B05B 7/10; B05B 7/16; B22F 9/08; B22F 9/10
(Continued)

(56) References Cited

U.S. PATENT DOCUMENTS 3,963,178 A 6/1976 Collins
5,125,574 A * 6/1992 Anderson ..... B22F 9/082 239/433
(Continued)

FOREIGN PATENT DOCUMENTS

JP S4820752 A 3/1973
JP S61108323 U 7/1986
(Continued)

OTHER PUBLICATIONS

International Search Report and Written Opinion for International Application No. PCT/JP2018/002303 dated Mar. 27, 2018; 12pp.
(Continued)

*Primary Examiner* — Steven J Ganey
(74) *Attorney, Agent, or Firm* — Hauptman Ham, LLP

(57) ABSTRACT

A gas atomization nozzle includes a through-hole formed along a center line; a nozzle portion configured of a Laval nozzle which is disposed around the center line and provided to be inclined at a predetermined angle toward the center line; and swirling motion imparting means for imparting a swirling flow around the center line to gas which is injected from the nozzle portion. The nozzle portion is formed in a ring shape which is continuous around the center line, and the swirling motion imparting means is configured as a fin provided in the nozzle portion to impart a swirling flow.

5 Claims, 8 Drawing Sheets

(51) Int. Cl.
*B22F 9/10* (2006.01)
*B22F 9/08* (2006.01)

(58) Field of Classification Search
USPC ..... 239/399, 403, 418, 433, 79, 83
See application file for complete search history.

(56) References Cited

U.S. PATENT DOCUMENTS 6,142,382 A * 11/2000 Ting ..... B22F 9/082
239/433
6,569,245 B2 * 5/2003 Krysa ..... B05B 7/1404
239/79

FOREIGN PATENT DOCUMENTS

| | | | |
|---|---|---|---|
| JP | H04173906 | A | 6/1992 |
| JP | 2004269956 | A | 9/2004 |
| JP | 2005139471 | A | 6/2005 |
| JP | 2006241490 | A | 9/2006 |
| JP | 2007535643 | A | 12/2007 |
| KR | 1020140095192 | A | 9/2014 |

OTHER PUBLICATIONS

Extended European Search Report for European Application No. 18745071.3 dated Jul. 27, 2020; 8pp.

* cited by examiner

GAS ATOMIZATION NOZZLE AND GAS ATOMIZATION DEVICE

RELATED APPLICATIONS

The present application is a National Phase of International Application Number PCT/JP2018/002303 filed Jan. 25, 2018 and claims priority from Japanese Application Number 2017-013238 filed Jan. 27, 2017.

TECHNICAL FIELD

The present invention relates to a gas atomization nozzle and a gas atomization device.

BACKGROUND ART

For example, PTL 1 discloses a nozzle in a gas atomization method for obtaining metal powder by injecting high-speed gas to a flowing-down molten steel flow, in which a Laval nozzle is used as an annular nozzle.

CITATION LIST

Patent Literature

[PTL 1] Japanese Unexamined Utility Model Registration Application Publication No. 61-108323

SUMMARY OF INVENTION

Technical Problem

In PTL 1, a gas flow can be accelerated to a supersonic speed by applying the Laval nozzle. However, it is shown that the molten steel flow even further expands and blows up, so that it is necessary to set the total length of a blocking portion to at least ½ of a nozzle inner diameter. In this manner, in a gas atomization nozzle, it is known that there is a concern that the production of metal powder may be affected merely by setting the gas flow to the supersonic speed.

Further, from the viewpoints of injectionability or sinterability in a metal powder injection molding method or from the viewpoint of improving surface roughness in a three-dimensional metal molding method, it is desirable that the metal powder is fine powder (for example, 45 μm or less). However, in metal powder which is produced by a general gas atomization nozzle, variation in particle size is large and the yield of fine powder is as low as less than 20% from one ingot material.

The present invention is for solving the above-described problem and has an object to provide a gas atomization nozzle and a gas atomization device, in which it is possible to produce fine powder with less variation in particle size.

Solution to Problem

In order to achieve the above object, according to an aspect of the present invention, there is provided a gas atomization nozzle including: a through-hole formed along a center line; a nozzle portion configured of a Laval nozzle which is disposed around the center line and provided to be inclined at a predetermined angle toward the center line; and swirling motion imparting means for imparting a swirling flow around the center line to gas which is injected from the nozzle portion.

According to the gas atomization nozzle, gas that is a supersonic flow is injected toward the molten metal passing through the through-hole by the nozzle portion configured as a Laval nozzle, whereby it is possible to produce the metal powder as fine powder. Further, in the case of the gas that is a supersonic flow, the direction of the flow of the gas which is injected from the nozzle portion becomes unstable due to turbulence of an air current. In this regard, according to the gas atomization nozzle, a swirling flow is imparted to the gas which is injected from the nozzle portion by the swirling motion imparting means, whereby the flow of the gas that is a supersonic flow which is injected from the nozzle portion is rectified, so that the direction of the flow is stabilized. For this reason, it is possible to prevent the produced metal powders from colliding with each other to change the shapes thereof, or to prevent the produced metal powders from coming into contact with and sticking to each other, and it is possible to suppress variation in the particle size of the metal powder. Further, it is possible to restrain the produced metal powder from sticking to an opening portion of the nozzle portion, and thus it is possible to prevent the nozzle portion from being blocked due to the stuck metal powder. Further, the produced metal powder is dispersed by a centrifugal force due to the swirling flow, whereby it is possible to produce the metal powder as fine powder.

Further, in the gas atomization nozzle according to the aspect of the present invention, it is preferable that the nozzle portion is formed in a ring shape which is continuous around the center line and the swirling motion imparting means is configured of a gas filling portion to which the nozzle portion is connected and which forms a ring-shaped space which is continuous around the center line, and a gas supply portion causing the gas to flow in along the ring shape of the gas filling portion.

According to the gas atomization nozzle, the swirling flow can be imparted with a simple configuration in which blades or the like for generating a swirling flow are not provided.

Further, in the gas atomization nozzle according to the aspect of the present invention, it is preferable that the nozzle portion is formed in a ring shape which is continuous around the center line and the swirling motion imparting means is configured as a fin provided in the nozzle portion to impart a swirling flow.

According to the gas atomization nozzle, since the swirling flow is imparted by the fin, it is possible to reliably impart the swirling flow.

Further, in the gas atomization nozzle according to the aspect of the present invention, the nozzle portion may be configured as a Laval nozzle by the fin.

According to the gas atomization nozzle, since the fin performs both a function of imparting the swirling flow and a function of the Laval nozzle, it is not necessary to design the functions by sharing with the nozzle portion side, so that the nozzle can be easily manufactured.

Further, in the gas atomization nozzle according to the aspect of the present invention, it is preferable that the nozzle portion is formed as a plurality of holes provided around the center line and that as the swirling motion imparting means, each of the holes is formed in a spiral shape with the center line as a center.

According to the gas atomization nozzle, since the swirling flow is imparted by the spiral shape of the hole of each nozzle portion, it is possible to reliably impart the swirling flow.

In order to achieve the above object, according to another aspect of the present invention, there is provided a gas atomization device including: a vacuum vessel having an evacuated interior; a molten metal supply part which melts metal in the vacuum vessel; and the gas atomization nozzle according to any one of the above aspects, which injects gas to molten metal flowing down from the molten metal supply part.

According to the gas atomization device, fine powder with less variation in particle size is produced, and therefore, it is possible to improve the production efficiency of the fine powder having a specified particle size.

Advantageous Effects of Invention

According to the present invention, it is possible to produce fine powder with less variation in particle size.

DESCRIPTION OF EMBODIMENTS

Hereinafter, an embodiment of the present invention will be described in detail based on the drawings. The present invention is not limited by this embodiment. Further, the constituent elements in the following embodiment include constituent elements which can be easily replaced by those skilled in the art or constituent elements which are substantially identical thereto.

Figure 1:
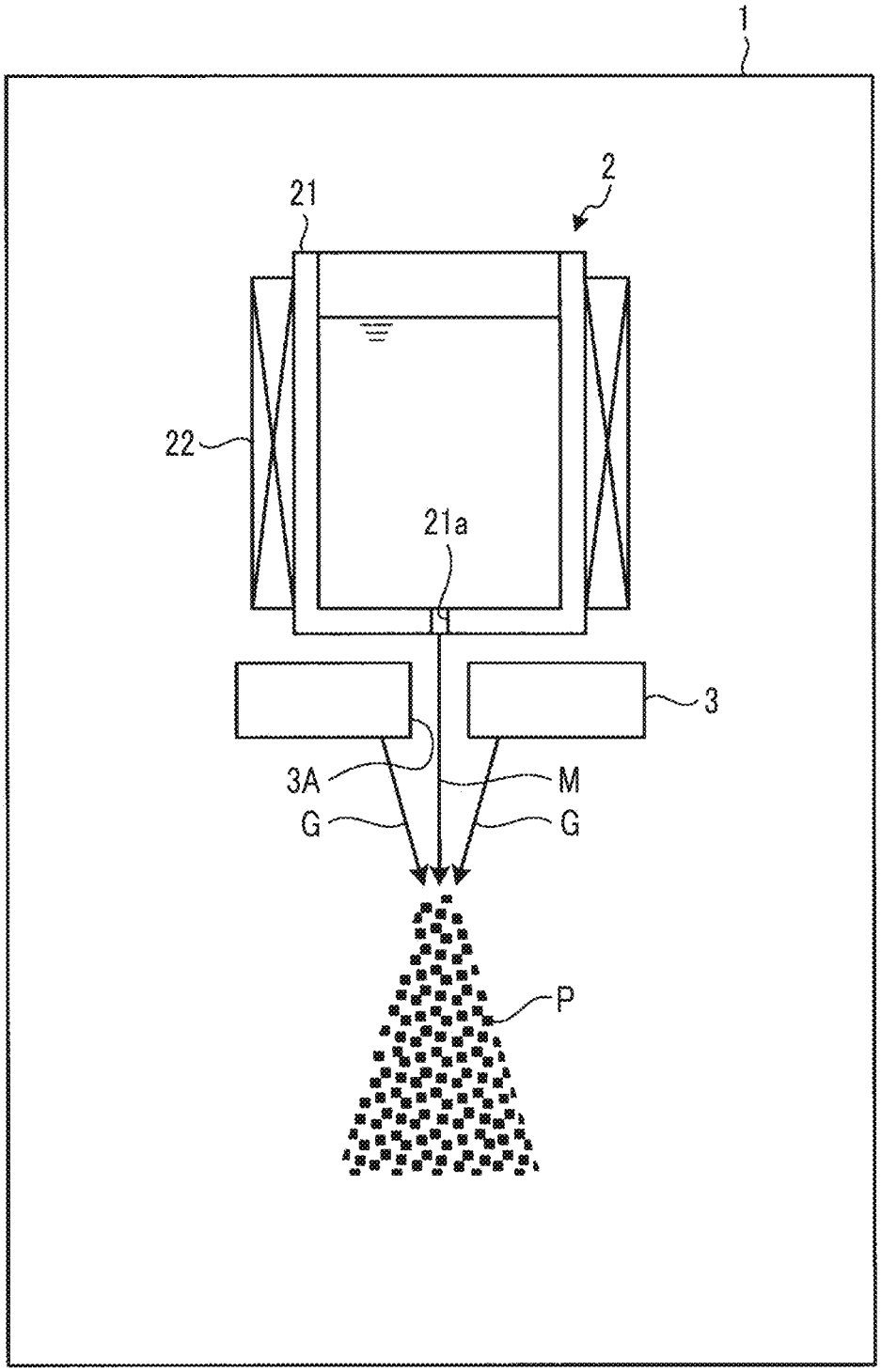
FIG. 1 is a schematic configuration diagram of a gas atomization device according to an embodiment of the present invention.
Figure 2:
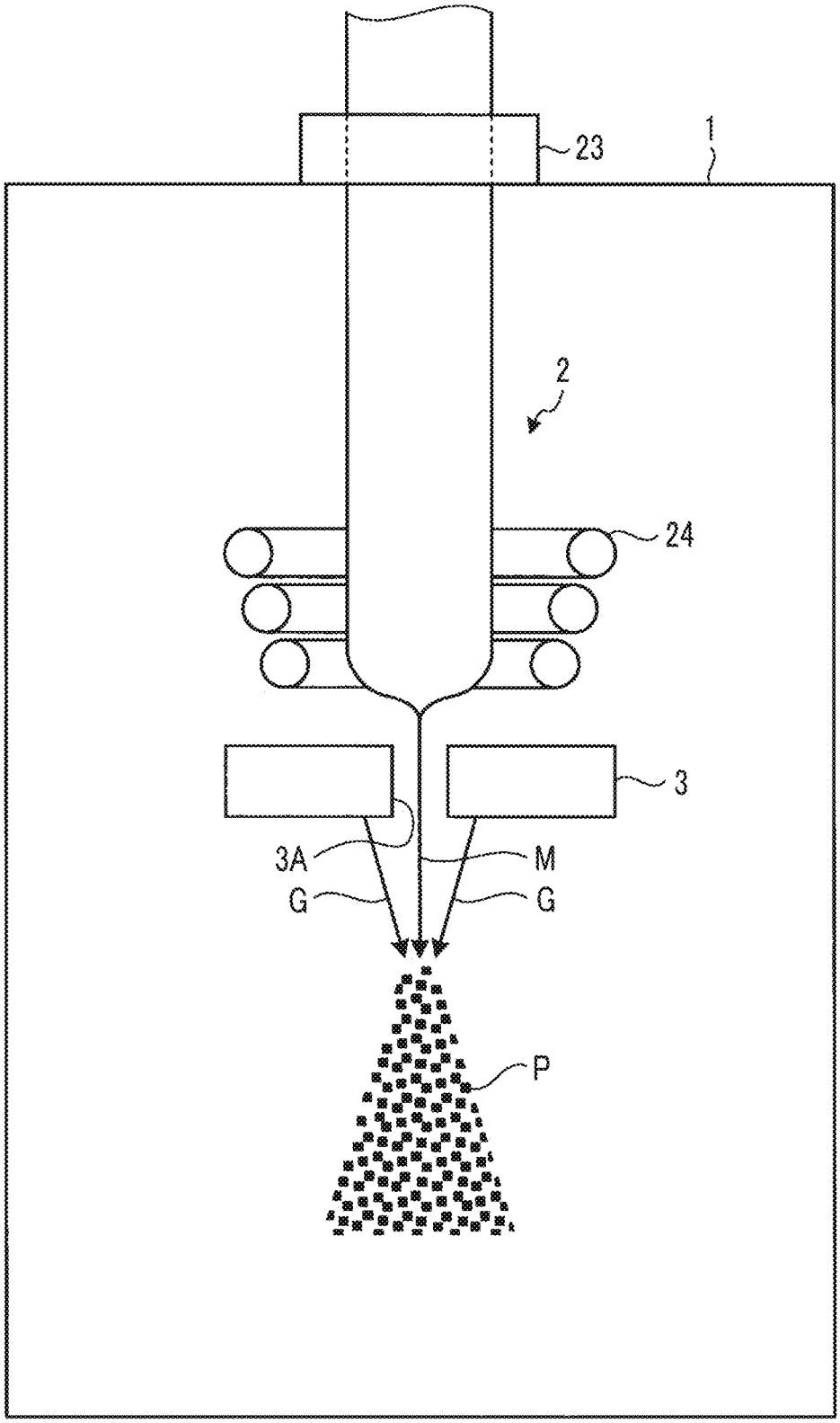
FIG. 2 is a schematic configuration diagram of another example of the gas atomization device according to the embodiment of the present invention.
Figure 3:
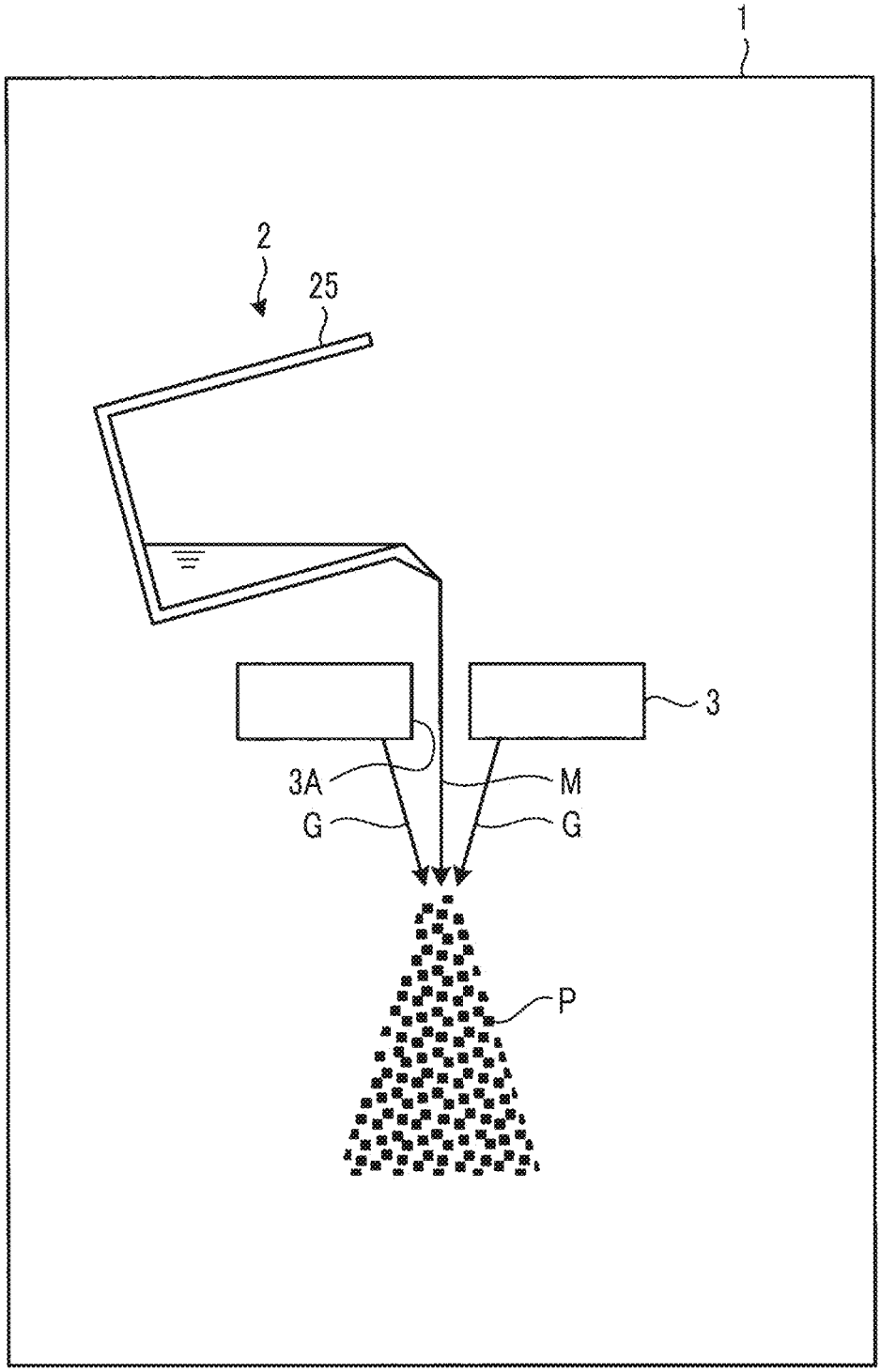
FIG. 3 is a schematic configuration diagram of another example of the gas atomization device according to the embodiment of the present invention.

FIGS. 1 to 3 are schematic configuration diagrams of a gas atomization device according to this embodiment.

As shown in FIG. 1, the gas atomization device of this embodiment is for producing metal powder P and includes a vacuum vessel 1, a molten metal supply part 2, and a gas atomization nozzle (hereinafter referred to as a nozzle) 3. The vacuum vessel 1 has an inert gas atmosphere by being filled with an inert gas after the interior thereof is evacuated. The molten metal supply part 2 has an accommodation container 21 for accommodating a metal ingot serving as a base of the metal powder P, and a heating part for melting the metal ingot in the accommodation container 21. The accommodation container 21 is made of a heat-resistant material, and a discharge port 21*a* through which the melted molten metal flows downward is provided in a bottom portion so as to be able to be opened and closed. The heating part 22 heats the accommodation container 21, for example. The nozzle 3 is for injecting gas G to molten metal M flowing down from the discharge port 21*a* of the accommodation container 21. The nozzle 3 has a through-hole 3A through which the flowing-down molten metal M passes, and injects the gas G toward the molten metal M passing through the through-hole 3A. Therefore, the molten metal M is momentarily formed into droplets and cooled by the injected gas G to be produced as the metal powder P.

As shown in FIG. 2, a gas atomization device of another example of this embodiment is for producing the metal powder P and includes the vacuum vessel 1, the molten metal supply part 2, and the gas atomization nozzle (hereinafter referred to as a nozzle) 3. The vacuum vessel 1 has an inert gas atmosphere by being filled with an inert gas after the interior thereof is evacuated. The molten metal supply part 2 has a support part 23 for supporting a metal rod serving as a base of the metal powder P, and a heating part 24 for melting the metal rod supported by the support part 23. The support part 23 vertically supports the metal rod such that a lower end of the metal rod is disposed toward the nozzle 3. The heating part 24 heats and melts the metal rod, and for example, an induction heating coil is applied. The nozzle 3 is for injecting the gas G to the molten metal M flowing down from the lower end of the metal rod. The nozzle 3 has the through-hole 3A through which the flowing-down molten metal M passes, and injects the gas G toward the molten metal M passing through the through-hole 3A. Therefore, the molten metal M is momentarily formed into droplets and cooled by the injected gas G to be produced as the metal powder P.

As shown in FIG. 3, a gas atomization device of another example of this embodiment is for producing the metal powder P and includes the vacuum vessel 1, the molten metal supply part 2, and the gas atomization nozzle (hereinafter referred to as a nozzle) 3. The vacuum vessel 1 has an inert gas atmosphere by being filled with an inert gas after the interior thereof is evacuated. The molten metal supply part 2 has an accommodation container 25 which accommodates the molten metal M obtained by melting metal serving as a base of the metal powder P in advance. The accommodation container 25 may be provided with the discharge port 21*a* provided in the bottom portion so as to be able to be opened and closed, as shown in FIG. 1. However, the accommodation container 25 may be configured such that the molten metal M is poured into the nozzle 3 from an upper opening portion by being inclined, as shown in FIG. 3. The nozzle 3 is for injecting the gas G to the molten metal M flowing down from the accommodation container 25. The nozzle 3 has the through-hole 3A through which the flowing-down molten metal M passes, and injects the gas G toward the molten metal M passing through the through-hole 3A. Therefore, the molten metal M is momentarily formed into droplets and cooled by the injected gas G to be produced as the metal powder P.

The gas atomization devices shown in FIGS. 1 to 3 are merely examples, and the molten metal supply part 2 is not limited to the above-described configuration as long as it can supply the molten metal M to the nozzle 3.

Figure 4:
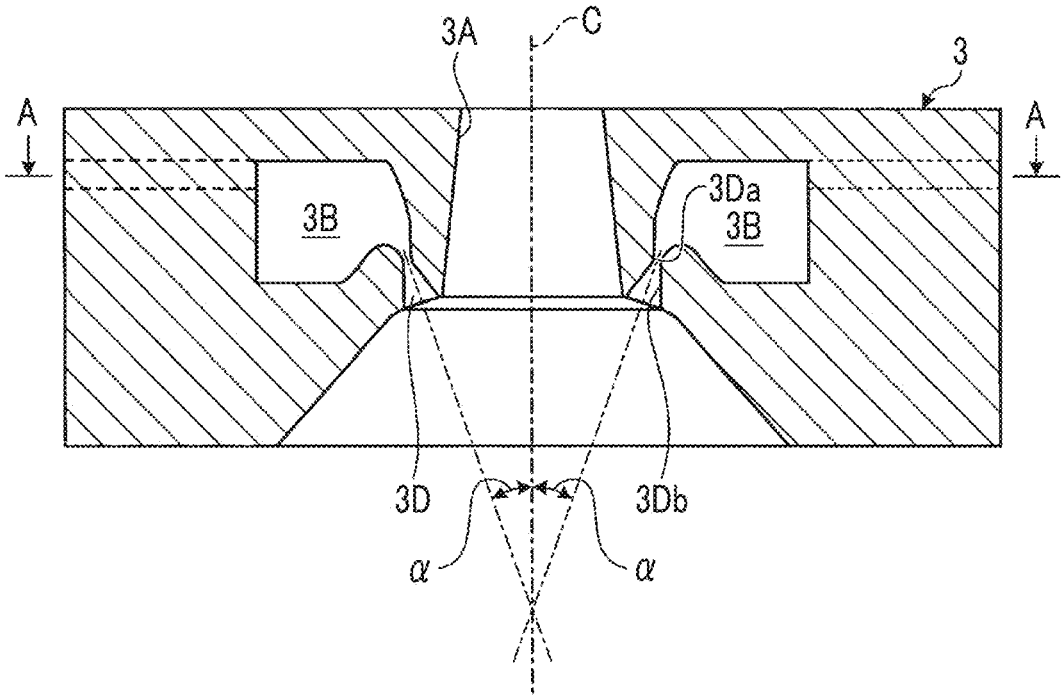
FIG. 4 is a side sectional view of a gas atomization nozzle according to the embodiment of the present invention.
Figure 5:
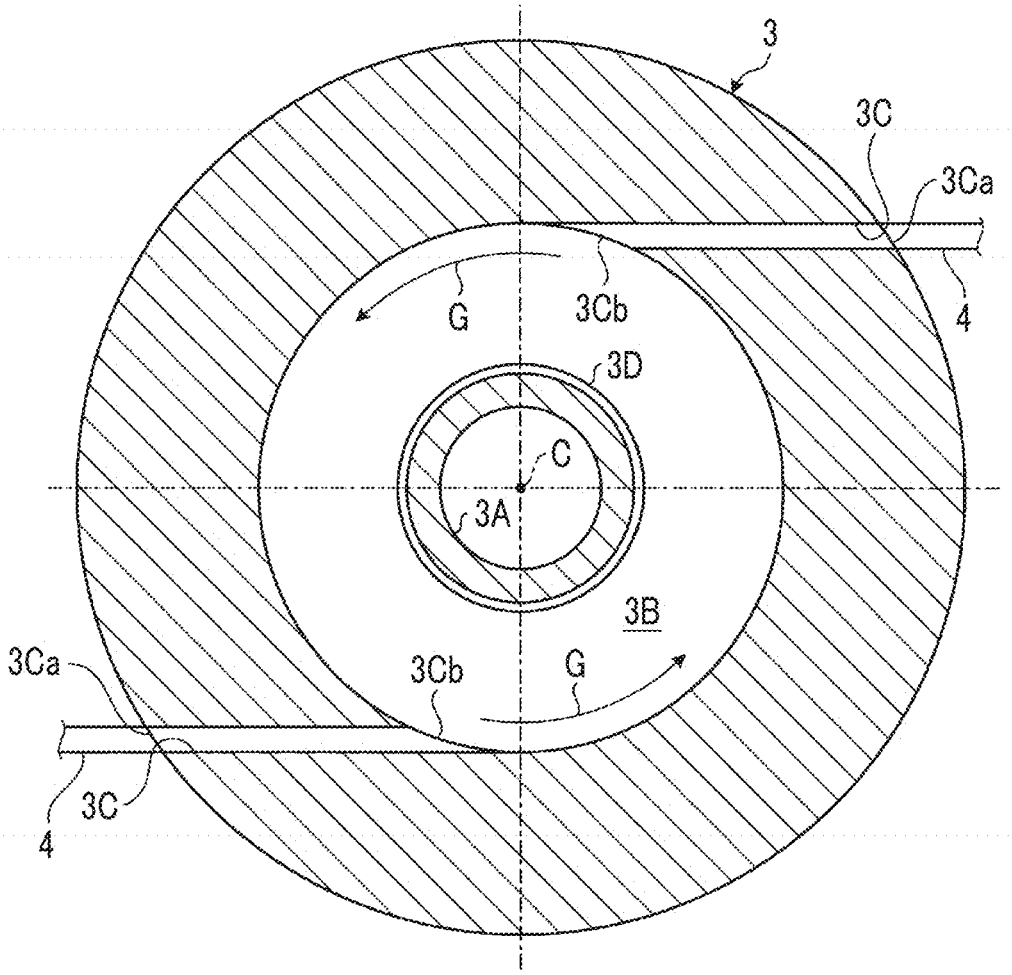
FIG. 5 is a plan sectional view of the gas atomization nozzle according to the embodiment of the present invention.

FIG. 4 is a side sectional view of the gas atomization nozzle according to this embodiment. FIG. 5 is a plan sectional view (a sectional view taken along the line A-A in FIG. 4) of the gas atomization nozzle according to this embodiment.

As shown in FIGS. 4 and 5, the nozzle (gas atomization nozzle) 3 is provided with the through-hole 3A described above, a gas filling portion 3B, a gas supply portion 3C, and a nozzle portion 3D.

The through-hole 3A is formed along a center line C extending in the vertical direction at the center of the nozzle 3. That is, the nozzle 3 is formed in a ring shape with the through-hole 3A as the center. The center line C is a reference line extending downward from the discharge port 21*a* of the accommodation container 21 in the gas atomization device described above. Therefore, the molten metal M which is discharged from the discharge port 21*a* of the accommodation container 21 flows down along the center line C.

The gas filling portion 3B forms a ring-shaped space which is formed in the interior of the nozzle 3 and is continuous around the center line C with the center line C as the center.

The gas supply portion 3C is a hole that penetrates the nozzle 3 and communicates with the gas filling portion 3B. One end 3Ca thereof communicates with the outside of the nozzle 3 and the other end 3Cb communicates with the gas filling portion 3B. In the gas supply portion 3C, a gas supply pipe 4 is connected to one end 3Ca. The gas supply pipe 4 is a pipe for feeding the gas G from a compressed gas generating part (not shown). Therefore, the gas supply portion 3C supplies compressed gas G to the interior of the gas filling portion 3B.

The nozzle portion 3D is disposed around the center line C with the center line C as the center. The nozzle portion 3D shown in FIGS. 4 and 5 is formed in a ring shape which is continuous around the center line C. Further, the nozzle portion 3D is formed to communicate with the gas filling portion 3B and to be open around the through-hole 3A. Further, the nozzle portion 3D is provided to be inclined toward the center line C at a predetermined angle α with respect to the center line C. The nozzle portion 3D has a throttle portion 3Da formed in a passage in which a portion communicating with the gas filling portion 3B is narrow, and an enlarged portion 3Db formed such that a passage is gradually widened from the throttle portion 3Da toward an opening portion, and is configured as a Laval nozzle. Therefore, in the nozzle portion 3D, the compressed gas G in the interior of the gas filling portion 3B increases in speed when passing through the throttle portion 3Da and expands when passing through the enlarged portion 3Db, thereby being injected as a supersonic flow.

Further, the nozzle 3 of this embodiment is provided with swirling motion imparting means. The swirling motion imparting means is for imparting a swirling flow around the center line C to the gas G which is injected from the nozzle portion 3D, and In the nozzle 3 in the form shown in FIGS. 4 and 5, the swirling motion imparting means is configured of the gas filling portion 3B and a gas supply portion 3C.

In the swirling motion imparting means, the gas filling portion 3B forms a ring-shaped space which is continuous around the center line C. Further, in the swirling motion imparting means, the gas supply portion 3C is provided along a tangent line to a ring-shaped circle of the gas filling portion 3B so as to cause the gas G to flow in along the ring shape of the gas filling portion 3B. That is, the swirling motion imparting means causes the gas G to flow in along the ring shape of the gas filling portion 3B from the gas supply portion 3C, thereby imparting a swirling flow along the ring shape of the gas filling portion 3B to the gas G. Then, the gas G with the swirling flow imparted thereto is injected by the nozzle portion 3D along the swirling flow around the center line C.

In this manner, the gas atomization nozzle 3 of this embodiment is provided with the through-hole 3A formed along the center line C, the nozzle portion 3D configured of a Laval nozzle which is disposed around the center line C and provided to be inclined at a predetermined angle α toward the center line C, and the swirling motion imparting means for imparting a swirling flow around the center line C to the gas G which is injected from the nozzle portion 3D.

According to the gas atomization nozzle 3, the gas G that is a supersonic flow is injected toward the molten metal M passing through the through-hole 3A in the gas atomization device by the nozzle portion 3D configured as a Laval nozzle, whereby it is possible to produce the metal powder P as fine powder.

Further, in the case of the gas G that is a supersonic flow, the direction of the flow of the gas G which is injected from the nozzle portion 3D becomes unstable due to turbulence of an air current. In this regard, according to the gas atomization nozzle 3, a swirling flow is imparted to the gas G which is injected from the nozzle portion 3D by the swirling motion imparting means, whereby the flow of the gas G that is a supersonic flow which is injected from the nozzle portion 3D is rectified, so that the flow direction is stabilized. For this reason, it is possible to prevent the produced metal powders P from colliding with each other to change the shapes thereof, or to prevent the produced metal powders P from coming into contact with and sticking to each other, and it is possible to suppress variation in the particle size of the metal powder P. Further, it is possible to restrain the produced metal powder P from adhering to the opening portion of the nozzle portion 3D, and thus it is possible to prevent the nozzle portion 3D from being blocked due to the attached metal powder P. Further, the produced metal powder P is dispersed by a centrifugal force due to the swirling flow, whereby it is possible to produce the metal powder P as fine powder.

Further, in the gas atomization nozzle 3 of this embodiment, it is preferable that the nozzle portion 3D is formed in a ring shape which is continuous around the center line C and the swirling motion imparting means is configured of the gas filling portion 3B to which the nozzle portion 3D is connected and which forms a ring-shaped space which is continuous around the center line C, and the gas supply portion 3C causing the gas G to flow in along the ring shape of the gas filling portion 3B.

According to the gas atomization nozzle 3, the swirling flow can be imparted with a simple configuration in which blades or the like for generating a swirling flow are not provided.

Figure 6:
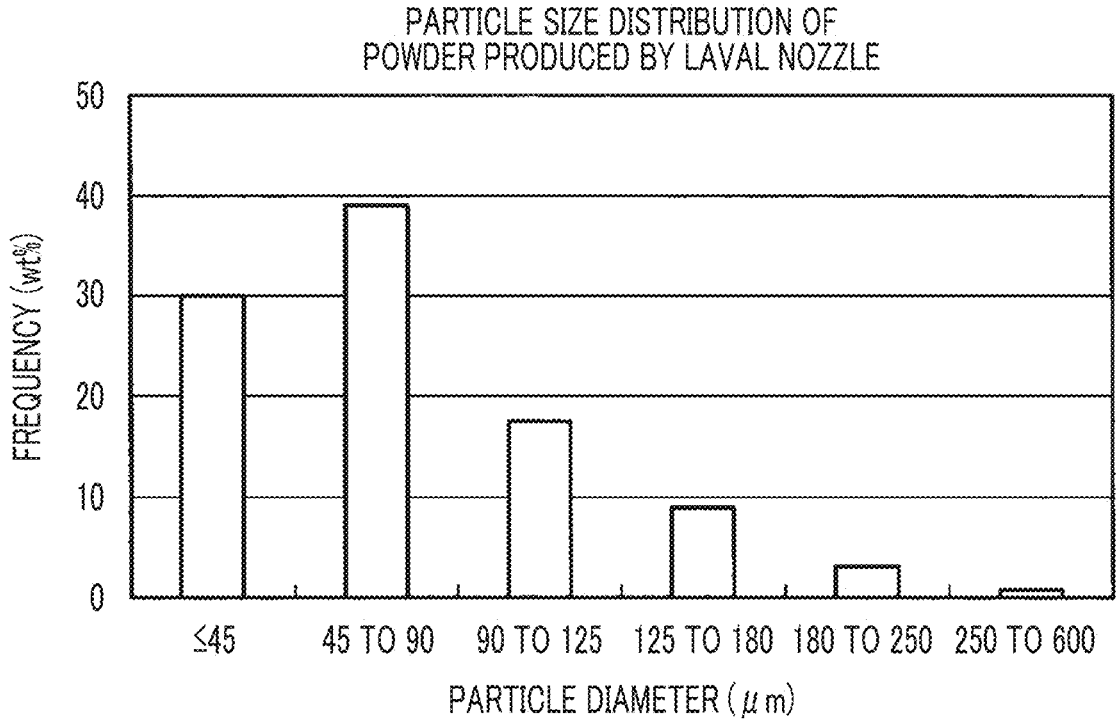
FIG. 6 is a diagram showing a particle size distribution of powder produced by the gas atomization nozzle according to the embodiment of the present invention.
Figure 7:
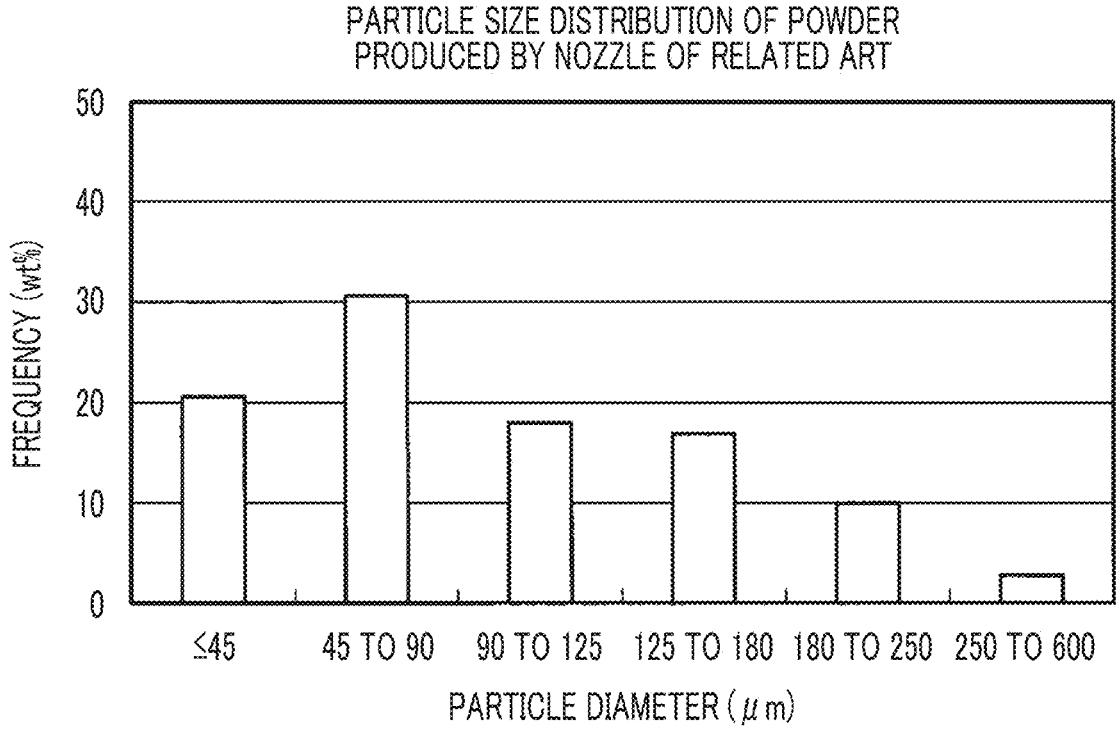
FIG. 7 is a diagram showing a particle size distribution of powder produced by a gas atomization nozzle of the related art.

FIG. 6 is a diagram showing a particle size distribution of the powder produced by the gas atomization nozzle according to the embodiment of the present invention. FIG. 7 is a diagram showing a particle size distribution of the powder produced by a gas atomization nozzle of the related art. In the configuration described above, in producing the metal powder P made of a TiAl alloy and having a particle diameter of 45 μm or less, the nozzle 3 of this embodiment in which the swirling motion imparting means described above is applied thereto and a Laval nozzle is applied to the nozzle portion 3D (FIG. 6) and the nozzle of the related art to which a Laval nozzle is not applied (FIG. 7) were compared with each other with the viscosity of the molten metal M, the pressure of the gas G which is supplied to the gas filling portion 3B, and the angle α with respect to the center line C of the nozzle portion 3D constant. As a result, as shown in FIGS. 6 and 7, it was apparent that the nozzle 3 of this embodiment in which the swirling motion imparting means is applied thereto and a Laval nozzle is applied to the nozzle portion 3D has less variation in the particle size of the produced metal powder P, compared to the nozzle of the related art to which a Laval nozzle is not applied.

Figure 8:
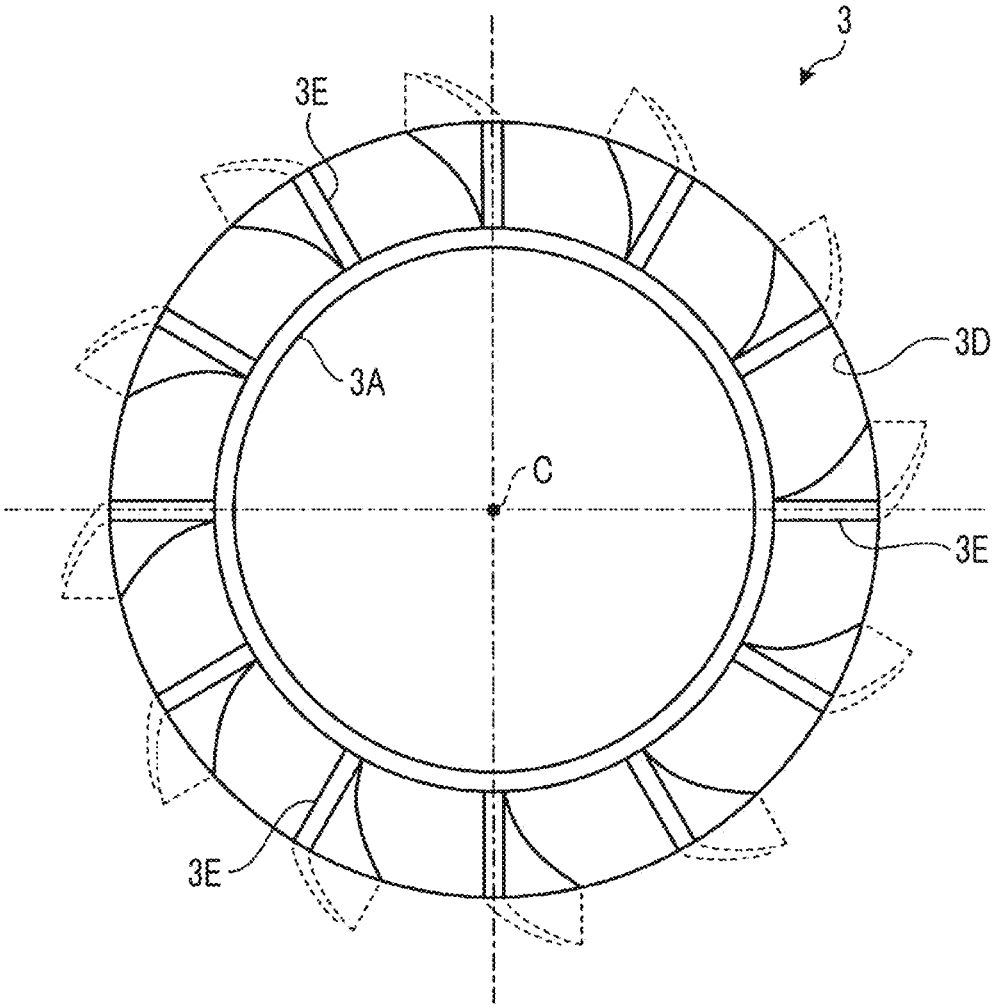
FIG. 8 is a partially enlarged bottom view showing another example of the gas atomization nozzle according to the embodiment of the present invention.

FIG. 8 is a partially enlarged bottom view showing another example of the gas atomization nozzle according to this embodiment.

In the nozzle 3 shown in FIG. 8, the nozzle portion 3D is formed in a ring shape which is continuous around the center line C, and is configured as a Laval nozzle, as shown in FIGS. 4 and 5. Then, the swirling motion imparting means is configured by a fin 3E disposed in the nozzle portion 3D. A plurality of fins 3E are disposed at predetermined intervals along the ring shape of the nozzle portion 3D, and each fin 3E is formed to be curved in a spiral shape with the center line C as the center. Therefore, the gas supply portion 3C does not need to generate a swirling flow in the gas filling portion 3B, and thus the gas supply portion 3C is not provided along the tangent line to the ring-shaped circle of the gas filling portion 3B.

In this manner, in the nozzle 3 shown in FIG. 8, the nozzle portion 3D is formed in a ring shape which is continuous around the center line C, and the swirling motion imparting means may be configured as the fin 3E provided in the nozzle portion 3D to impart a swirling flow.

Also in the nozzle 3 shown in FIG. 8, it is possible to produce the metal powder P as fine powder and suppress variation in the particle size of the metal powder P. Furthermore, according to the nozzle 3 shown in FIG. 8, since the swirling flow is imparted by the fins 3E, the swirling flow can be reliably imparted compared to the nozzle 3 shown in FIGS. 4 and 5.

Further, in the nozzle 3 shown in FIG. 8, the nozzle portion 3D may be configured as a Laval nozzle by the fin 3E. That is, the nozzle portion 3D itself does not have the throttle portion 3Da and the enlarged portion 3Db described above, and the throttle portion 3Da and the enlarged portion 3Db are formed due to the shape and disposition of the fin 3E. Also in this configuration, it is possible to produce the metal powder P as fine powder and suppress variation in the particle size of the metal powder P, and furthermore, since the swirling flow is imparted by the fins 3E, the swirling flow can be reliably imparted compared to the nozzle 3 shown in FIGS. 4 and 5. In particular, since the fin 3E performs both a function of imparting a swirling flow and a function of a Laval nozzle, it is not necessary to design the functions by sharing with the nozzle portion 3D side, so that the nozzle 3 can be easily manufactured.

Figure 9:
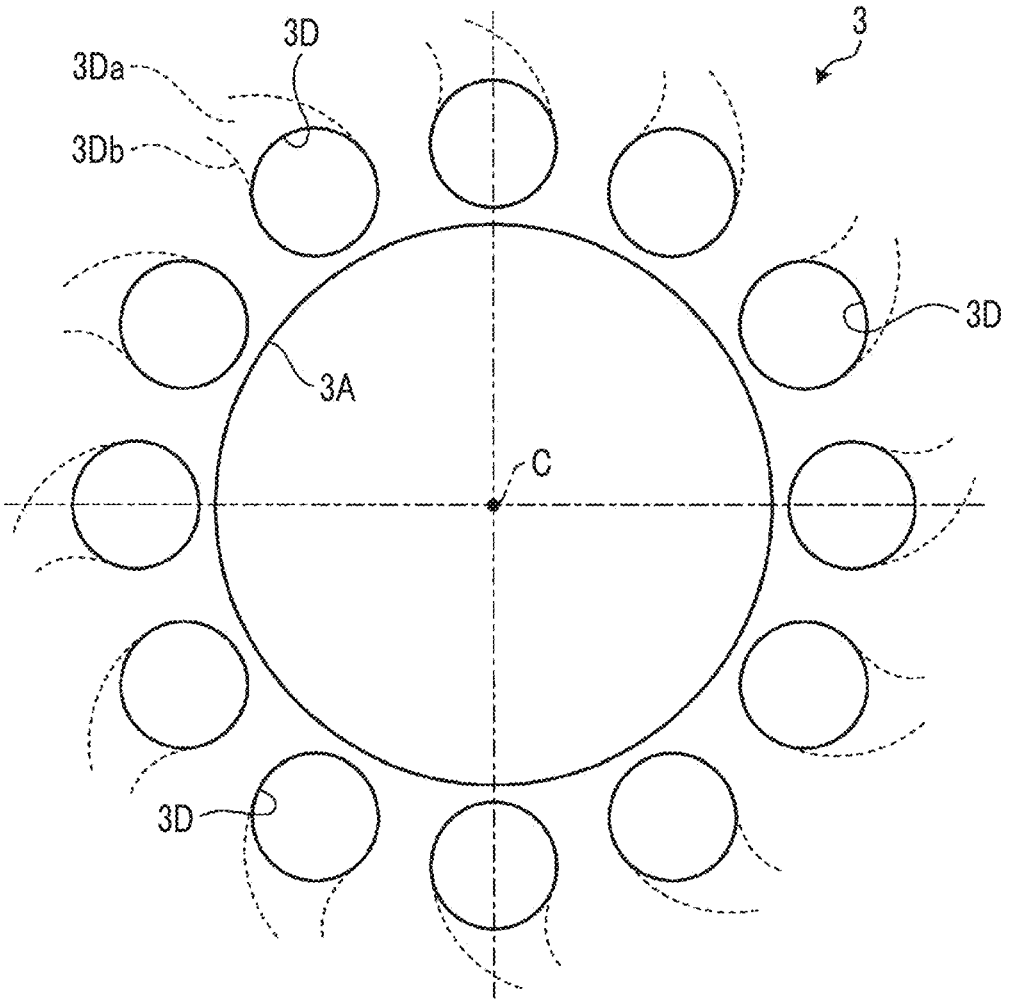
FIG. 9 is a partially enlarged bottom view showing another example of the gas atomization nozzle according to the embodiment of the present invention.

FIG. 9 is a partially enlarged bottom view showing another example of the gas atomization nozzle according to this embodiment.

In the nozzle 3 shown in FIG. 9, the nozzle portions 3D are formed as a plurality of holes provided around the center line C. The hole of each nozzle portion 3D has the throttle portion 3Da and the enlarged portion 3Db described above, and each hole is configured as a Laval nozzle. Then, the hole of each nozzle portion 3D is formed to be curved in a spiral shape with the center line C as the center, whereby the swirling motion imparting means is configured.

Also in the nozzle 3 shown in FIG. 9, it is possible to produce the metal powder P as fine powder and suppress variation in the particle size of the metal powder P. Furthermore, according to the nozzle 3 shown in FIG. 9, since the swirling flow is imparted due to the spiral shape of the hole of each nozzle portion 3D, the swirling flow can be reliably imparted compared to the nozzle 3 shown in FIGS. 4 and 5.

Further, according to the gas atomization device which is provided with the nozzle 3 having any one of the configurations described above, fine powder with less variation in particle size is produced, and therefore, it is possible to improve the production efficiency of the fine powder having a specified particle size.

REFERENCE SIGNS LIST

1: vacuum vessel
2: molten metal supply part
21: accommodation container
21*a*: discharge port
22: heating part
23: support part
24: heating part
25: accommodation container
3: gas atomization nozzle (nozzle)
3A: through-hole
3B: gas filling portion
3C: gas supply portion
3Ca: one end
3Cb: other end
3D: nozzle portion
3Da: throttle portion
3Db: enlarged portion
3E: fin
4: gas supply pipe
C: center line
G: gas
M: molten metal
P: metal powder
α: angle

The invention claimed is:

1. A gas atomization nozzle comprising:
a through-hole formed along a center line;
a nozzle portion configured of a Laval nozzle which is disposed around the center line and provided to be inclined at a predetermined angle toward the center line; and
swirling motion imparting means for imparting a swirling flow around the center line to gas which is injected from the nozzle portion, wherein
the nozzle portion is formed in a ring shape which is continuous around the center line, and the swirling motion imparting means is configured as a fin provided in the nozzle portion to impart a swirling flow.

2. The gas atomization nozzle according to claim 1, wherein the nozzle portion is configured as a Laval nozzle by the fin.

3. A gas atomization device comprising:
a vacuum vessel having an evacuated interior;
a molten metal supply part which melts metal in the vacuum vessel; and
the gas atomization nozzle according to claim 1, which injects gas to molten metal flowing down from the molten metal supply part.

4. A gas atomization nozzle comprising:
a through-hole formed along a center line;
a nozzle portion configured of a Laval nozzle which is disposed around the center line and provided to be inclined at a predetermined angle toward the center line; and swirling motion imparting means for imparting a swirling flow around the center line to gas which is injected from the nozzle portion, wherein the nozzle portion is formed as a plurality of holes provided around the center line, and each of the holes is formed to be curved in a spiral shape with the center line as a center to configure the swirling motion imparting means.

5. A gas atomization device comprising:

a vacuum vessel having an evacuated interior;

a molten metal supply part which melts metal in the vacuum vessel; and the gas atomization nozzle according to claim 4, which injects gas to molten metal flowing down from the molten metal supply part.

* * * * *